US005181016A

United States Patent [19]

Lee

[11] Patent Number: 5,181,016

[45] Date of Patent: Jan. 19, 1993

[54] MICRO-VALVE PUMP LIGHT VALVE DISPLAY

[75] Inventor: Yee-Chun Lee, Cabin John, Md.

[73] Assignee: The United States of America as represented by the United States Department of Energy, Washington, D.C.

[21] Appl. No.: 641,391

[22] Filed: Jan. 15, 1991

[51] Int. Cl.[5] ..... G09G 3/34

[52] U.S. Cl. ..... 340/788; 359/228

[58] Field of Search ..... 350/269, 267; 40/406, 40/407; 340/783, 788, 763, 752; 359/227, 228

[56] References Cited

U.S. PATENT DOCUMENTS

| | | | |
|---|---|---|---|
| 3,516,185 | 7/1968 | Hilborn | 340/788 |
| 4,418,346 | 11/1983 | Batchelder | 340/783 |
| 4,569,575 | 2/1986 | Le Pesant et al. | 359/227 |
| 4,636,785 | 1/1987 | Le Pesant | 340/788 |
| 4,701,021 | 10/1987 | Le Pesant et al. | 359/228 |
| 4,875,064 | 10/1989 | Umeda et al. | 353/78 |

*Primary Examiner*—Alvin E. Oberley
*Assistant Examiner*—Amare Mengistu
*Attorney, Agent, or Firm*—Ray G. Wilson; Paul D. Gaetjens; William R. Moser

[57] ABSTRACT

A flat panel display incorporates a plurality of micro-pump light valves (MLV's) to form pixels for recreating an image. Each MLV consists of a dielectric drop sandwiched between substrates, at least one of which is transparent, a holding electrode for maintaining the drop outside a viewing area, and a switching electrode from accelerating the drop from a location within the holding electrode to a location within the viewing area. The sustrates may further define non-wetting surface areas to create potential energy barriers to assist in controlling movement of the drop. The forces acting on the drop are quadratic in nature to provide a nonlinear response for increased image contrast. A crossed electrode structure can be used to activate the pixels whereby a large flat panel display is formed without active driver components at each pixel.

14 Claims, 3 Drawing Sheets

MICRO-VALVE PUMP LIGHT VALVE DISPLAY

This invention is the result of a contract with the Department of Energy (Contract No. W-7405-ENG-36).

BACKGROUND OF INVENTION

This invention relates to flat panel displays and, more particularly, to non-light-emitting flat panel displays.

Flat panel displays have received considerable interest as the demand for ultra-light weight, low power miniature displays has increased for both character and graphic output. However, while conventional CRT displays are bulky, no current flat panel technologies can provide the picture quality and brightness, reliability, durability, and ease of manufacture of the CRT. Some of the best flat panel display technologies, i.e., backlit double-supertwisted nematic liquid crystal display (LCD) devices, gas plasma devices, or electroluminescent displays, can compete in such areas as pixel contrast ratio and life, but only at the expense of uncomfortable viewing angle, slow response time, and low brightness.

Of the non-light-emitting displays, LCD displays are probably the most widely used. LCD displays use nematic liquid crystals operating on the principle that, when an electric field is applied, the direction parallel to the molecular axes becomes polarized to a different degree than the polarization in the perpendicular directions. Thus, light passing through the nematic layer is polarized as a function of the applied electric field. By sandwiching the nematic crystal layer between variously polarized layers, the light transmission through the sandwich can be controlled by the application of voltage to represent individual pixels.

LCD devices advantageously have very low power consumption and light weight. However, increasing the display contrast ratio and brightness requires double supertwist crystals and backlighting, both of which increase power consumption and add bulk. The main difficulty of LCD technology concerns pixel-addressing. Displays with conventional crossed-electrode addressing, with no active elements on each line, are limited in size because of the reduced ratio of on-voltage to off-voltage at a large number of scan lines. One alternative is to provide an active addressing scheme with thin-film transistors at each pixel. Thin-film transistors provide a memory characteristic to greatly increase contrast, but introduce substantial fabrication difficulties for large area devices.

These problems are addressed by the present invention, and an improved non-light-emitting flat panel display device is provided with increased brightness and contrast using only crossed-electrode addressing, and with memory capability for reduced power consumption. Accordingly, it is an object of the present invention to provide a flat panel display device that is non-light-emitting and can operate with passive addressing over a large area display.

It is another object of the present invention to provide a flat panel display device that requires only low power.

One other object of the present invention is a flat panel display device with gray level and color capabilities.

An object of the present invention is a flat panel display device with a high resolution display.

Still another object is a flat panel display that is light weight and compact.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a flat panel display device having pixels formed by drops of a dielectric fluid that are moved by adjacent electric fields to define an image. In one embodiment, a pattern of non-wetted surfaces is also formed on substrate panels enclosing the dielectric drops to define potential energy barriers for confining movement of the drops. The drops are pumped to and from display windows for image formation.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE DRAWINGS

Figure 1:
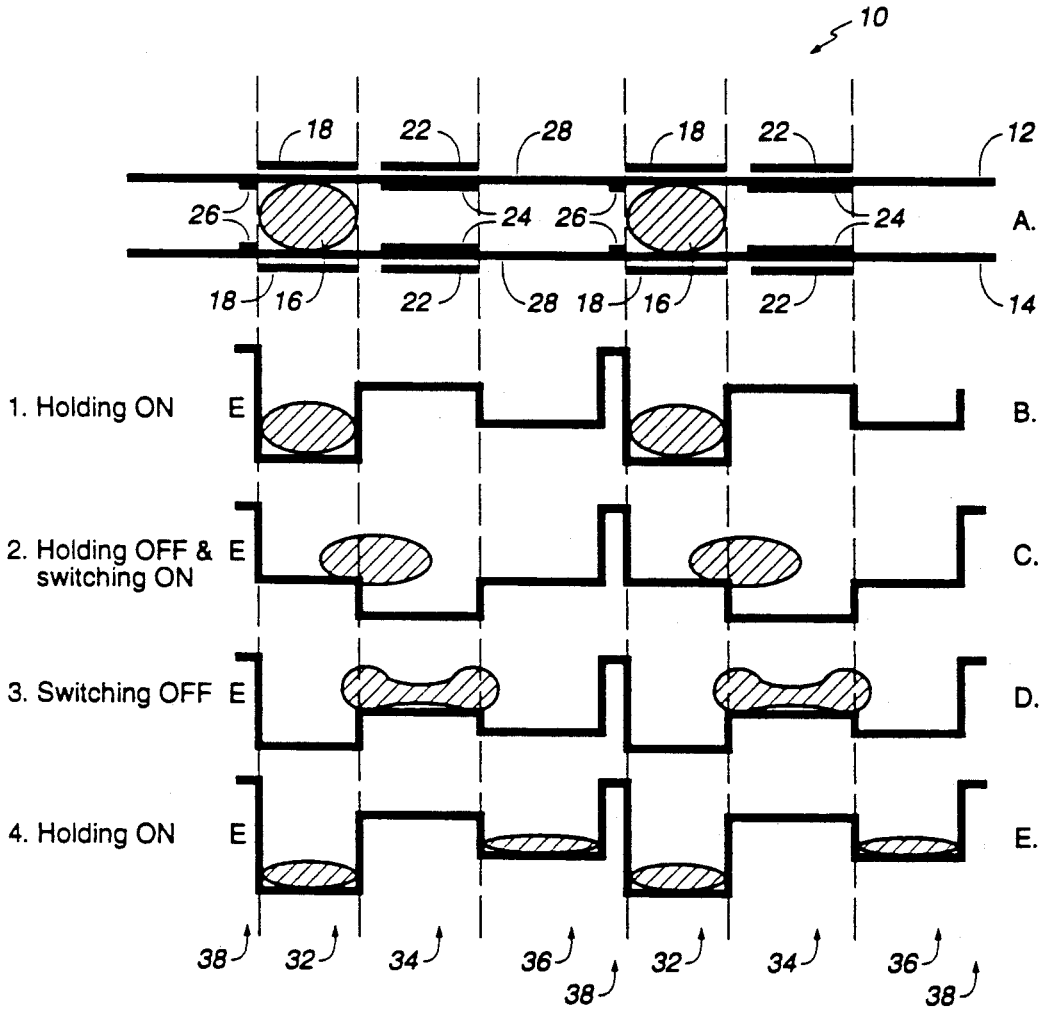
FIG. 1A–E a pictorial drawing illustrating the principles of the present invention.

Referring now to FIG. 1, there is pictorially illustrated the principles of the present invention, characterized hereafter as a micro-pump light valve (MLV). The basic principle of the MLV is that of electrohydrodynamics, which states that a dielectric body tends to be attracted to a region of increased electric field, provided that the dielectric constant is greater than that of the surrounding area. The force that the dielectric body experiences is directly proportional to the gradient of the square of the electric field strength. The squared relationship results because the polarization that the external field induces on the body is itself proportional to the external field strength, and the force exerted on the body is proportional to the product of the field strength and the magnitude of the polarization. The gradient relationship arises from the dipolar nature of the induced polarization.

The fact that the expression for the force acting on a dielectric body is proportional to the gradient of the square of the applied electric field implies the following: first, an effective potential energy can be defined for the dielectric body that is just the negative of the square of the applied field, multiplied by a constant depending on the geometry and the dielectric constants of both the body and the surrounding material; second, the square dependence means that the sign of the force does not change when the electric field changes sign. Because of the inherent inertia of the dielectric body, the body responds to the mean square of the driving voltage, i.e., the device can be driven by either AC or DC power.

It should be noted that the use of DC power would likely introduce deleterious electrochemical effects in the dielectric, leading to serious lifetime problems. The ability to apply AC power, even in the audio-frequency range, alleviates the problem. The RMS response of the dielectric drop also enhances the threshold behavior of the dielectric. Without the nonlinear quadratic response the threshold response would be inadequate to support passive matrix addressing.

Referring now to FIG. 1A, a pictorial illustration of a flat panel display device incorporating pixels that operate according to the above principles is shown in cross-section. Display device 10 is comprised of transparent substrates 12, 14 that sandwich dielectric fluid drops 16 therebetween. Holding electrodes 18 and switching electrodes 22 introduce electric field potentials effective to pump drops 16 into and out of viewing area 28, as hereinafter explained.

In a preferred embodiment of the present invention, the MLV is operated by the combined action of holding electrodes 18 and switching electrodes 22, together with non-wetting surface patterns 24, 26 formed on the surfaces of substrates 12, 14 confining dielectric drops 16. The non-wetting coating defines effective potential energy barriers because of the lack of surface affinity between the working fluid and the non-wetting surface. It should be noted that the physical size of a pixel is on the order of $30\times30\times100$ microns, and the droplet size is then only a mere 30 microns in diameter. The surface energy is then an order of magnitude larger than the potential energy of gravity, and comparable to the electrostatic energy, so that the potential barriers created by the non-wetting material is of the same order as the potential energy well generated by the electrodes.

Operation of the flat panel display may be understood by reference to FIGS. 1A–E. Electrodes 18 and 22 and non-wetted areas 26 and 24 create a plurality of potential energy barriers and wells: holding potential well 32. switching potential well 34, and holding barriers adjacent viewing areas 36. In the "ON" state (FIG. 1B), i.e., clear visual access through viewing areas 36, a holding voltage is applied across holding electrodes 18 with no voltage across switching electrodes 22. The potential energy "well" created by the voltage across holding electrodes 18 and the "walls" created by non-wetted areas is sufficient to hold the dielectric droplet 16 in position between holding electrodes 18 to withstand a large accelerating force.

To move the fluid to the "OFF" state (FIG. 1C), i.e., to position droplet 16 within viewing area 36, a large switching voltage is applied to switching electrodes 22 to lower the potential barrier created by non-wetted surface 24. At the same time, the holding voltage across holding electrodes 18 is reduced to zero to create a potential gradient effective to accelerate droplet 16. Drop 16 quickly traverses switching electrode 22 within the dwell time of the switching voltage. Once drop 16 has moved to viewing area 36, the switching voltage is again turned off and holding voltage turned on (FIGS. 1D and 1E) to restore the potential barrier 34 from non-wetted surface 24 and potential well 32 from holding electrode 18 and prevent drop 16 from returning to holding electrode 18.

To reset the pixel to the "ON" state after it has been turned "OFF", both the switching and holding voltages are turned on to create a continuous potential gradient from viewing area 36 to holding potential area 32. This gradient is effective to accelerate drop 16 back to holding electrode 18. The switching voltage is then turned off to restore the pixels to the condition shown in FIG. 1B. It is estimated that the response time of the dielectric drop 16. i.e., the pixel, can exceed 10 KHz (compared with a LCD response of 10 Hz).

It will be appreciated that the action of non-wetted surface 24 also provides a gray scale capability for flat panel display 10. As illustrated in FIG. 1D, drop 16 tends to divide as the non-wetting potential is restored by turning off the switching voltage. If the timing of the switching voltage is varied, a portion of drop 16 may be split off, with one portion continuing on to viewing area 36 and a remainder returning to holding electrode area 32.

The application of the non-wetted area potential barriers has an important additional affect: the pixel, once turned on, or off, will remain in that position for the entire frame duration, i.e, the MLV has inherent memory. The duty cycle of display 10 is, thus, effectively equal to one, enhancing the contrast ratio while reducing flickering. It will also be noticed that no polarizers or "transparent" electrode surfaces are required, thus providing an inherent increase in display brightness.

Figure 2A:
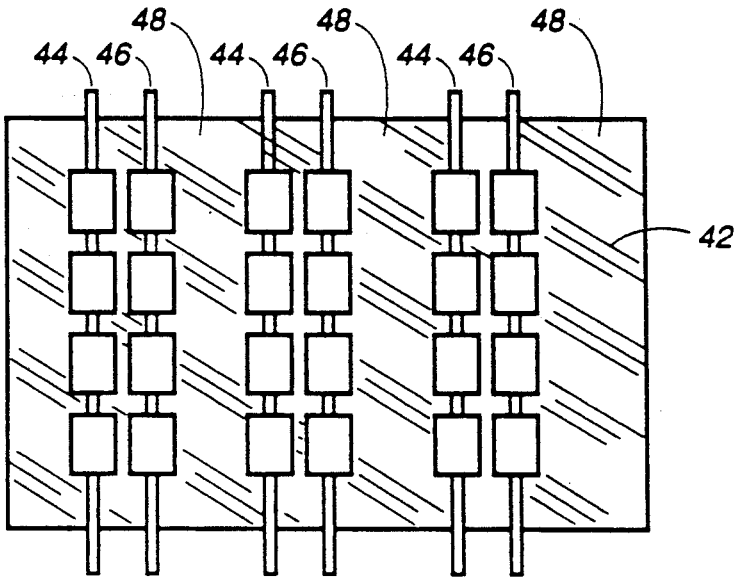
FIGS. 2A and 2B are plan views of electrode structures for addressing pixels of the present invention.
Figure 2B:
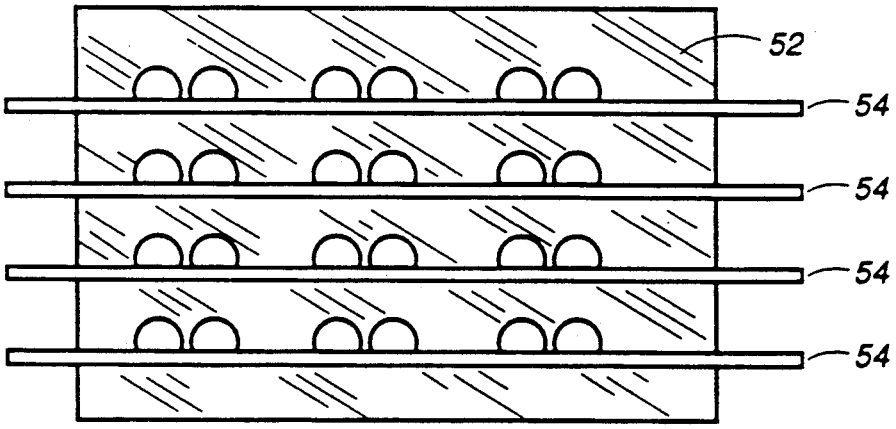

Referring now to FIGS. 2A and 2B, there is shown a matrix array for addressing the pixels units shown in FIG. 1A in a conventional x-y addressing scheme. Row lines 54 on substrate 52 enable the selection of pixels through the simultaneous application of voltage on the appropriate holding electrode column lines 44 and switching electrode column lines 46. The interaction of the electrical potentials and non-wetted surface potentials provide a "toggle" switching action, with a threshold switching action that maintains matrix addressibility as the number of addressible rows increases. A switching action on a selected pixel requires the simultaneous lowering of the holding voltage on column electrodes 44 and the raising of the switching voltage on column electrodes 46 with application of voltage on row electrodes 54. For the unintended pixels, the address voltages do not obtain the threshold switching voltage.

It will be further appreciated by reference to FIG. 1, that the energy stored in the drop surface tension can be designed to lie just below the threshold energy necessary for the drop to be accelerated over the switching barrier. Then, only a small amount of additional switching energy is needed to move the fluid drop over the potential barrier and switching voltages as low as 20–30 volts may be used. This low voltage can be provided by relatively inexpensive CMOS or bipolar transistors instead of expensive DMOS transistors. While the holding electrodes may operate at about 100 V and still require high voltage DMOS drivers for input, all of the holding electrode columns can be driven by a single driver and the row holding electrodes can be driven by the less expensive drivers.

It will also be appreciated from FIG. 1 and FIGS. 2A and 2B that a single MLV pixel consists of a pair of dielectric substrates 42, 52 to contain dielectric fluid drop 16 and pairs of holding 44, 54 and switching 46. 54 electrodes on the outer surfaces of plates 42, 52, where each pair occupies about one-third of the surface area of the pixel. For metallic electrodes, the area occupied by the electrodes is not for viewing, and only the viewing area 48, about one-third of the surface area, is available for viewing.

Figure 3:
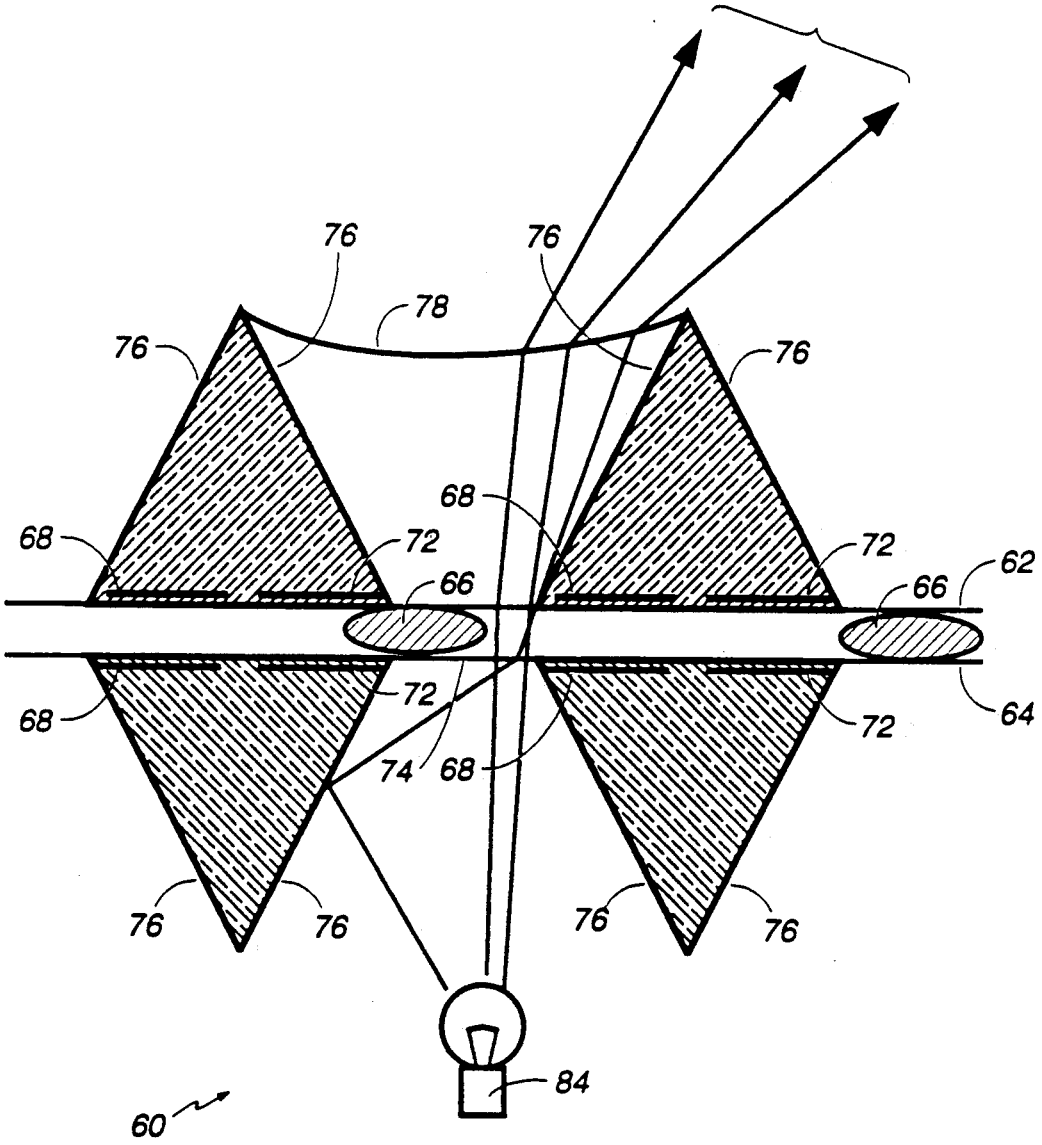
FIG. 3 is a pictorial illustration in partial cross-section of a pixel for use in a flat panel display according to the present invention.

FIG. 3 depicts one pixel embodiment for covering the nontransparent electrodes 68. 72 while using the entire pixel area for viewing. Triangular shaped mirrors 76 have a base region large enough to cover metallic electrodes 68, 72, while optically enlarging the viewed area of the pixel. When dielectric drop 66 is within holding electrode 68, ambient light can pass through viewing area 74. Similarly, when dielectric drop 66 is within viewing area 74, it absorbs the light. A dark colored dye or carbon black may be used to provide substantially complete light absorption. Backlighting 84 may be used or a diffusive reflective backplate (not shown) may be used to reflect light that has penetrated through viewing area 74. Provided that the incline angle of the mirror with respect to the normal plane is small enough, i.e., the height of the triangle is larger than the base length, the portion of light that does not reach the window can be shown to consist almost entirely of incident light with angles greater than 19.47° from the normal plane.

Thus, the mirrors do not restrict viewing in the normal plane, but the viewing angle is limited to about 20 degrees from either side of the normal plane. To remove this restriction, concave lens 78 may be provided in the region between triangular mirrors 76 and over the windows 74. Lens 78 serves to spread out the light reflected from a diffuse reflector so that it will have an approximate Lambertian distribution and, in combination with mirrors 76, creates the illusion that there is no "dead" space. The MLV mirror 76-lens 78 combination serves to both localize the light reflected from the back surface to the area of a single pixel 60, and to focus ambient light down to viewing area 74, with concomitant greater detail contrast and higher optical efficiency.

Referring again to gray scale capability, an alternate to the "pulse length modulation" approach described above is amplitude modulation of the switching pulse to cause the fluid to be accelerated at different rates. With a constant pulse length, the fluid will then traverse the switching region at varying speeds to affect the way the fluid drop is split. It is also possible to modulate the switching amplitude at frequencies close to multiples of inverse fluid transit time to destabilize the fluid movement, and, by varying the modulation frequency, to shatter the fluid into different fractions.

A color display capability may be obtained by using either color filter triads or staked multicolor schemes in view of the high resolution and high transparency inherent in the MLV display system. In a staked scheme, the dielectric fluid may be mixed with different color dyes, or the substrate dielectric plates may be color filters.

Fabrication of the lens-mirror system shown in FIG. 3 can be done by conventional micro-machining or, for mass production, might be done by casting or stamping.

The MLV flat panel display device is thus a novel application of magnetohydrodynamics using a microfluid-pump to pump drops of dielectric fluid of dark color into and out of transparent window regions to operate as light-valves. A unique mirror-lens combination focuses the viewing light and hides the fluid drop when the drops are in the "pixel-on" position. Sharp threshold behavior, together with the toggle-switch nature of the switching mechanism facilitates easy full-duty-cycle, high-contrast matrix addressing. High intrinsic transparency of the pixel optics provides the capability for a multilayer scheme for color display. A suitable dielectric drop may have a relatively large relative dielectric constant, i.e., greater than about 10, and relatively small viscosity, i.e., less than about 10 cp. Effective materials include methanol and glycol. Stable materials effective to form the non-wetting surfaces include polyethylene and teflon.

The foregoing description of embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A flat panel display device for recreating images in pixels, comprising:

a transparent substrate structure defining a plurality of non-conductive transparent viewing areas forming said pixels;

a plurality of drops of a dielectric fluid movably contained within said substrate structure;

holding electrodes for establishing an electric field effective to retain said drops at a location adjacent said viewing areas; and switching electrodes between said holding electrodes and said viewing areas for establishing an electric field effective to accelerate said drops from said location adjacent said viewing areas to a location within said viewing areas to form said images.

2. A flat panel display according to claim 1 wherein said substrate structure further defines potential energy barrier areas between adjacent ones of said pixels by first non-wetted surface areas facing said drops.

3. A flat panel display according to claim 2, further including second non-wetted surface areas disposed on said substrate structure beneath said switching electrodes and cooperating with said electric field established by said switching electrodes for generating a potential energy gradient effective for accelerating said drop between said locations adjacent said holding electrodes and said viewing areas.

4. A flat panel display according to claim 1, further including mirror means for covering said electrode means and optically enlarging said viewing areas to form a continuous image surface.

5. A flat panel display according to claim 4, further including convex lenses disposed above each said viewing area for increasing the effective viewing angle for said images.

6. A flat panel display according to claim 4 wherein said substrate structure further defines potential energy barrier areas between adjacent ones of said pixels by first non-wetted surface areas facing said drops.

7. A flat panel display according to claim 5 wherein said substrate structure further defines potential energy barrier areas between adjacent ones of said pixels by first non-wetted surface areas facing said drops.

8. A flat panel display according to claim 6, further including second non-wetted surface areas disposed on said substrate structure beneath said switching electrodes and cooperating with said electric field established by said switching electrodes for generating a potential energy gradient effective for accelerating said drop between said locations adjacent said holding electrodes and said viewing areas.

9. A flat panel display according to claim 7, further including second non-wetted surface areas disposed on said substrate structure beneath said switching electrodes and cooperating with said electric field established by said switching electrodes for generating a potential energy gradient effective for accelerating said drop between said locations adjacent said holding electrodes and said viewing areas.

10. A pixel in a flat panel display, comprising a micropump light valve using a dielectric fluid drop and having a non-conductive transparent viewing area, a holding electrode, and a switching electrode therebetween for causing said drop to move between said viewing area and said holding electrode, wherein a non-wetted surface is disposed between said switching electrode and said fluid drop for cooperating with an electrical field established by said switching electrode to generate a potential energy gradient effective for accelerating said drop between said holding electrode and said viewing area.

11. A pixel according to claim 10, further including a first non-wetted surface area adjacent said viewing area for creating a potential energy barrier between said viewing area and an abutting adjacent pixel.

12. A pixel according to claim 10, further including mirror means for covering said holding electrode and said switching electrode and optically enlarging said viewing area whereby adjacent pixels form a continuous viewing surface.

13. A pixel according to claim 12, further including a convex lenses disposed above said viewing area for increasing an effective viewing angle onto said viewing area.

14. A pixel according to claim 12, further including a first non-wetted surface area adjacent said viewing are for creating a potential energy barrier between said viewing area and an abutting adjacent pixel.

* * * * *